US005357587A

United States Patent [19]

Grodinsky et al.

[11] Patent Number: 5,357,587

[45] Date of Patent: Oct. 18, 1994

[54] DISTORTION REDUCTION IN LOUDSPEAKERS

[76] Inventors: Robert M. Grodinsky, 4448 W. Howard, Skokie, Ill. 60076; David G. Cornwell, 3735 N. Ridgeway, Chicago, Ill. 60618

[21] Appl. No.: 995,833

[22] Filed: Dec. 23, 1992

[51] Int. Cl.[5] ..... H04R 25/00

[52] U.S. Cl. ..... 381/199; 381/194; 381/201

[58] Field of Search ..... 381/194, 199, 201, 192, 381/195, 182, 197, 200; 181/144, 145, 147

[56] References Cited

U.S. PATENT DOCUMENTS

| | | | |
|---|---|---|---|
| 3,780,232 | 12/1973 | Ward | 381/194 |
| 4,465,906 | 8/1984 | Adolph et al. | 381/201 |
| 5,197,104 | 3/1993 | Padi | 381/194 |

FOREIGN PATENT DOCUMENTS

| | | | |
|---|---|---|---|
| 0177897 | 8/1986 | Japan | 381/199 |
| 0010999 | 1/1988 | Japan | 381/199 |
| 0121399 | 5/1988 | Japan | 381/199 |
| 0254897 | 10/1988 | Japan | 381/199 |
| 0261993 | 10/1988 | Japan | 381/199 |
| 0070196 | 3/1990 | Japan | 381/199 |

*Primary Examiner*—Curtis Kuntz
*Assistant Examiner*—Huyen D. Le
*Attorney, Agent, or Firm*—Nicholas A. Camasto

[57] ABSTRACT

A loudspeaker includes a pole piece that is transversely divided into magnetically coupled, but electrically isolated first and second sections. The first pole piece section is surrounded by the voice coil and is magnetically coupled to, but electrically isolated from, the loudspeaker bottom plate. Other versions include pairs of loudspeakers with reversed polarity magnets and magnetic intercoupling for offsetting distortion produced therein.

17 Claims, 5 Drawing Sheets

*PRIOR ART*
FIG. 1A
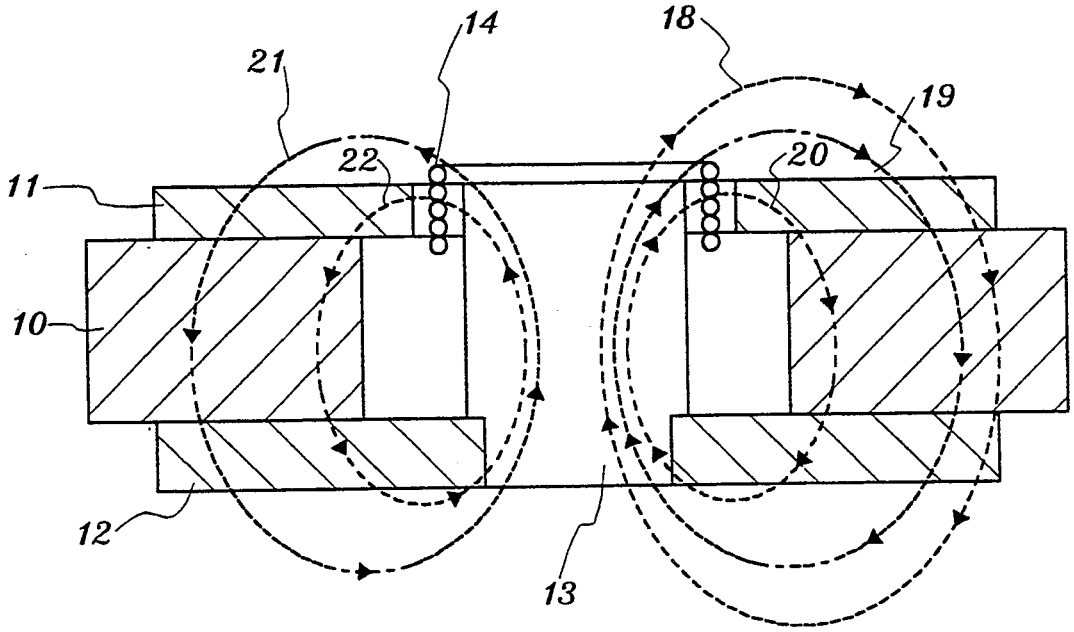
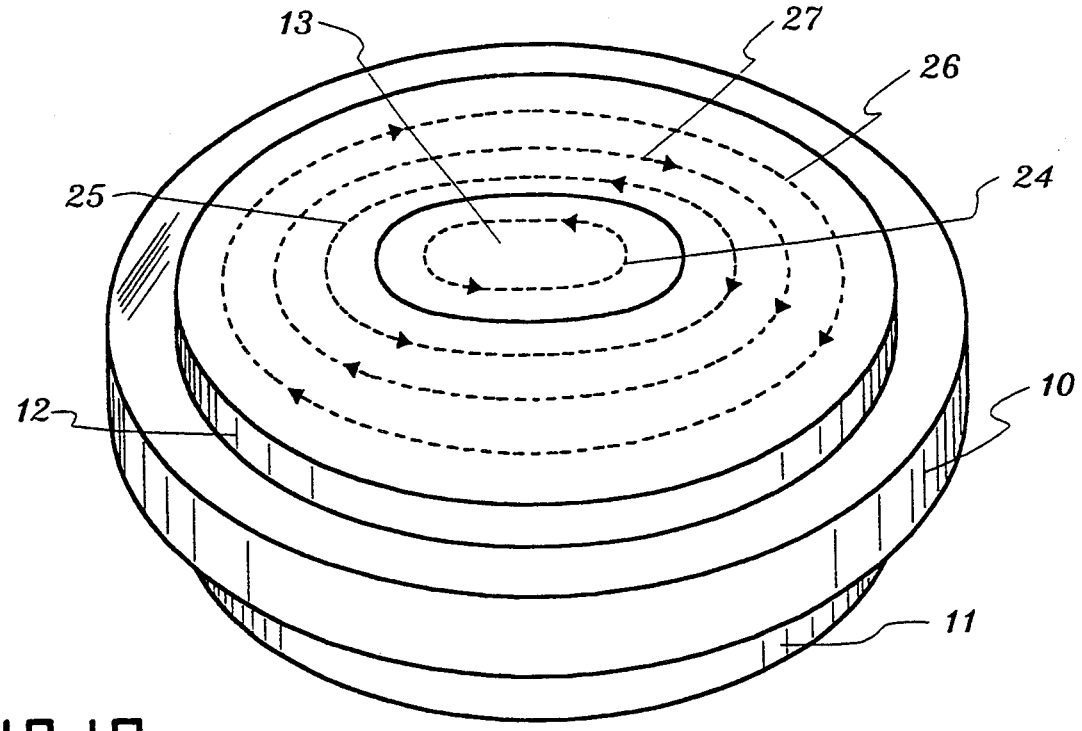
FIG. 1B
*PRIOR ART*

FIG. 2
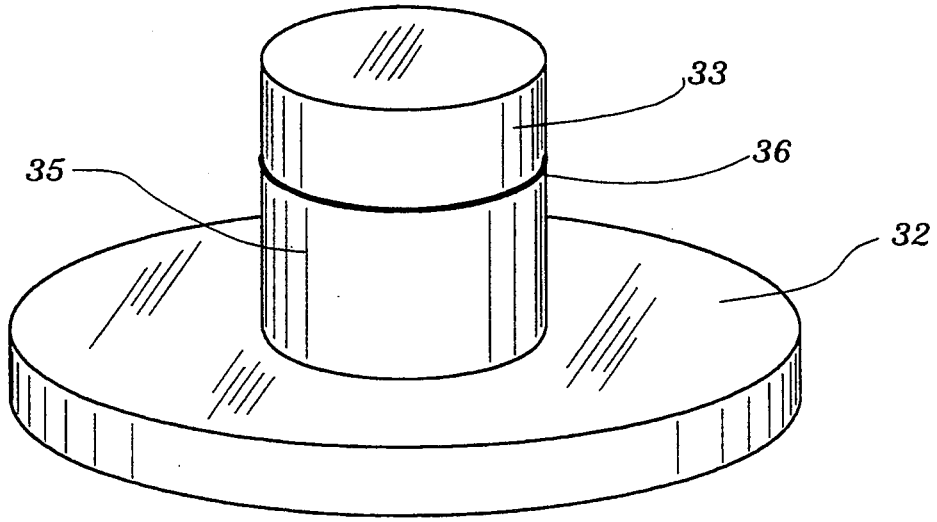
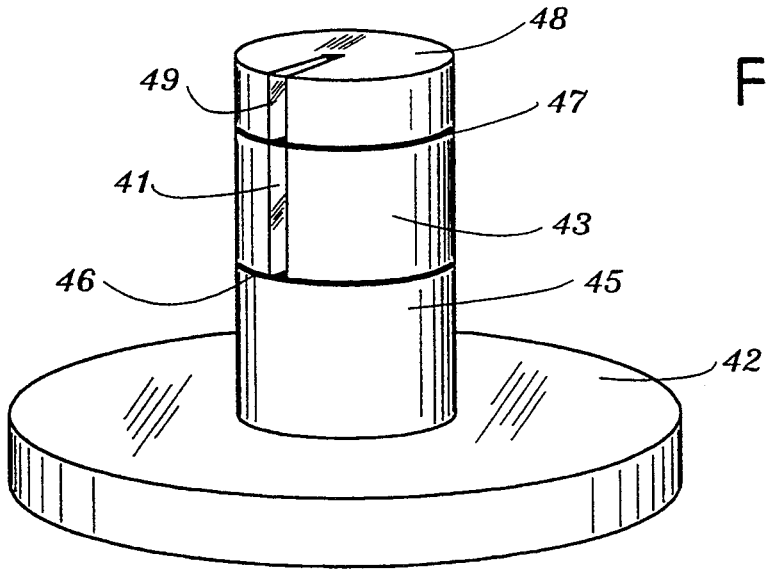
FIG. 3

DISTORTION REDUCTION IN LOUDSPEAKERS

BACKGROUND OF THE INVENTION AND PRIOR ART

This invention is generally concerned with magnetic distortion reduction in loudspeaker systems. U.S. Pat. No. 5,070,530, issued Dec. 3, 1991, to the inventors describes and claims a technique for reducing magnetic distortion that involves correcting for the effects of signal-related AC fields produced by the moving voice coil of the loudspeaker magnetic structure. The distortion producing effects described are inherent in the design of prior art loudspeaker magnetic structures and act both directly on the permanent magnet in the form of AC magnetic fields and indirectly through the magnetic and electric fields resulting from eddy currents which are produced by the voice coil energy. The patent teaches loudspeaker distortion reduction by incorporating one or more radial slots in one or more elements of the magnetic structure, i.e. the permanent magnet, and the top and bottom plates. The slots, which act as both electrical and magnetic barriers, effectively reduce circulating eddy currents in the plates, and magnetic and dielectric currents in the magnet.

The present invention is predicated on the fact that the pole piece contains a high concentration of AC energy, both as magnetic flux and as eddy currents because of its unique location within the voice coil. The invention, which involves isolation and redirection of the AC fields and the eddy currents associated with the pole piece to minimize interaction with the magnet and the bottom plate, has been found to substantially reduce loudspeaker distortion. In accordance with one aspect of the invention, the pole piece is transversely divided into two (or more) electrically isolated sections which interrupts the electric connection between the pole piece and the bottom plate, thereby decreasing the electric conduction of pole piece eddy currents in the bottom plate. The high concentration of AC flux in the pole tip (which has been isolated from the bottom plate) is routed into new magnetic return paths to minimize interaction with the magnet. The new magnetic return paths can be arranged around a single speaker driver in a single driver loudspeaker system or they may connect between speaker drivers in multiple driver loudspeaker systems. In multiple driver loudspeaker systems, the invention also provides the means for establishing mutual magnetic AC feedback between the drivers, which AC feedback further lowers distortion and minimizes the effects of differences between individual drivers. The effect is to minimize inaccuracies flowing from the lack of identical output from the individual drivers in multiple driver loudspeaker systems. The invention is also of benefit in loudspeaker systems that utilize crossovers for directing signals in various frequency bands among different drivers. Integration of the different size drivers to effect a coherent, seamless transition through the crossover region is greatly improved with the invention. Thus the lower distortion and more uniform driver characteristics that result from the invention produce substantial improvements not only in individual speaker drivers but in multiple driver loudspeaker systems.

OBJECTS OF THE INVENTION

A principal object of the invention is to provide an improved loudspeaker system of lower distortion.

A further object of the invention is to provide a loudspeaker with a novel pole piece construction.

Another object of the invention is to provide multiple loudspeaker systems of significantly lower distortion.

A still further object of the invention is to provide a multiple driver loudspeaker system that compensates for differences between individual drivers.

BRIEF DESCRIPTION OF THE DRAWINGS

These and other objects and advantages of the invention will be apparent upon reading the following description in conjunction with the drawings, in which:

FIG. 1A is a partial sectional view of a prior art loudspeaker magnetic structure illustrating magnetic flux paths;

FIG. 1B is a partial perspective view of the magnet structure of a prior art loudspeaker illustrating eddy current paths;

FIG. 2 illustrates a loudspeaker pole piece constructed in accordance with the invention;

FIG. 3 is a view illustrating a design variation in a loudspeaker pole piece;

DESCRIPTION OF THE PREFERRED EMBODIMENT

Figure 4:
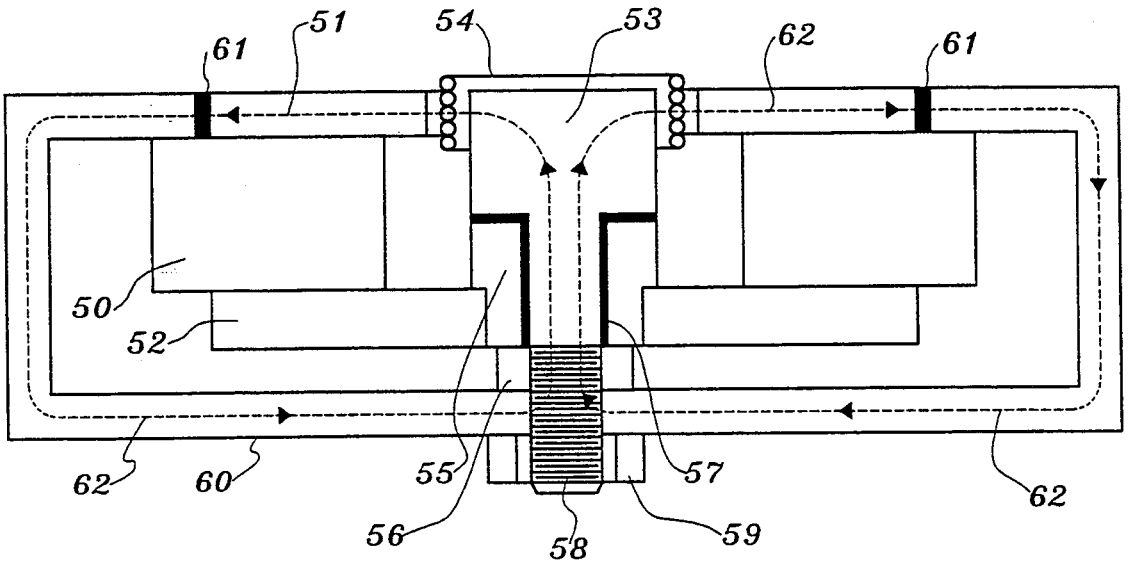
FIG. 4 is a partial cross sectional view of a single driver loudspeaker constructed in accordance with one aspect of the invention.

Referring to the prior art FIGS. 1A and 1B, a toroidally-shaped permanent magnet 10 is sandwiched between a magnetically permeable top plate 11 and a magnetically permeable bottom plate 12. Permanent magnet 10 is conventionally constructed of a ceramic material. A cylinder-shaped magnetically permeable pole piece 13 is centered in a circular opening of top plate 11 and is partially surrounded by a voice coil 14 that is supported for movement within the air gap formed between a circular opening in top plate 11 and pole piece 13. Voice coil 14 is connected to a source of AC signal current (not shown). The dashed curved lines 18, 19, 20, 21 and 22, with arrows indicating the direction of flow represent a few of the flux paths created by the permanent magnet 10 acting through the top plate 11, bottom plate 12 and pole piece 13. Since the voice coil 14 surrounds the pole piece 13, which is the common element in both the AC and DC magnetic circuits, the AC flux produced by voice coil 14 sees substantially the same magnetic paths as does the DC flux from the permanent magnet 10. Thus the magnetic flux paths are essentially the same for the permanent magnet 10 and for the voice coil 14. The AC magnetic flux produced by voice coil 14 produces distortion directly by acting on the magnet 10 to modulate its magnetic field, as shown by flux paths 19, 20, 21 and 22, and indirectly by inducing eddy currents into pole piece 13, top plate 11 and bottom plate 12. Such eddy currents result in magnetic distortions in the permeable material and generate magnetic and electrical fields that are in turn capable of modulating (and introducing distortion into) the magnet.

In FIG. 1B, which is a rear view of a loudspeaker magnetic structure, the paths of the AC signal induced eddy currents in bottom plate 12 and pole piece 13 are illustrated. For a given polarity of AC signal in voice coil 14, the dashed line 24 shows the direction of eddy current flow in pole piece 13. Dashed line 25 represents eddy current flow in bottom plate 12 that is electrically coupled from pole piece 13. For the same polarity AC signal, the eddy currents that traverse the outer paths illustrated by dashed lines 26 and 27 in bottom plate 12 rotate in a reverse direction from those illustrated by the dashed lines 24 and 25. The difference reflects the reversal that occurs as flux travelling up the pole piece changes direction as it returns through the top plate 11, the magnet 10 and the bottom plate 12 as shown in FIG. 1A. Because the voice coil 14 surrounds the pole piece 13, the AC flux and the resulting eddy currents are highly concentrated. In the prior art, the pole piece is both electrically and magnetically connected to the bottom plate, which allows the concentrated eddy currents to couple into the bottom plate where they oppose and partially cancel the reverse rotating eddy currents induced by the returning flux. The result is distortion in the form of smear due to the phase differences between eddy currents in the top plate 11, which is not electrically connected to the pole piece, and eddy currents in the bottom plate, which is electrically connected to the pole piece. The resultant electrical fields from these eddy currents in both top and bottom plates induce rotating dielectric currents in the magnet, which adds distortion.

FIG. 2 represents a generalized pole piece construction in accordance with the invention. Here the magnetically permeable pole piece has been transversely divided into a first section 33 and a second section 35, which are electrically insulated from each other by a thin layer of insulation 36. First section 33 is proportioned such that it extends for approximately the length of the voice coil. As a result of the division of the pole piece, most of the induced eddy currents in the pole piece are confined to first section 33 and are not electrically conducted into the base or lower section 35 of the pole piece or into the bottom plate 32. Thus, the division of the pole piece significantly reduces eddy current distortion. As a practical construction, the separate pole piece sections 33 and 35 and the insulation layer 36 (which may be in the form of a washer) can be glued together or alternatively, a long insulated center screw (not illustrated) may be used to secure the pole piece sections to the bottom plate. In the latter instance, the second pole piece section 35 would have a cylindrical hole formed in the center thereof through which the insulated center screw would pass.

In FIG. 3, a more complex pole piece structure is illustrated. This structure further reduces eddy current distortion with an insulated pole extension 48, which also helps to linearize the magnetic flux in the vicinity of the voice coil and to reduce variations in the voice coil inductance. In this version, the bottom plate 42 is in contact with the second pole piece section 45 which is insulated from first pole piece section 43 by thin insulating washer 46. Another thin insulating washer 47 insulates pole extension 48 from first pole piece section 43. Slots 41 and 49 are formed in first pole piece section 43 and pole extension 48, respectively, for further reducing distortion by altering the eddy current flow patterns to reduce the coupling of the energy therein to other magnetic circuit elements. The slots also increase the eddy current path lengths which increases the resistance of these paths.

In FIG. 4, one preferred form of the invention is shown in connection with a single driver loudspeaker. The pole piece is transversely divided into an upper first section 53 and a lower second section 55. The first section 53 has a T-shaped cross section with a leg that extends through a cylindrical hole in second section 55 out beyond bottom plate 52 and terminates in a threaded end 58. The interface between the first section 53 and the second section 55 of the pole piece consists of thin insulation 57 which prevents electrical contact between the pole piece sections and reduces electrical conduction of pole piece eddy currents into the bottom plate 52. Modulation of the permanent magnet 50 by AC magnetic fields and by eddy currents is reduced by adding a magnetically permeable member 60 that magnetically couples the first pole section 53 to the top plate 51. These new flux paths provided by member 60 have low reluctance and serve to divert the AC flux away from the magnet as indicated by the dashed line 62. The effect of the flux diversion is to reduce magnetic modulation and distortion in the loudspeaker.

Figure 5:
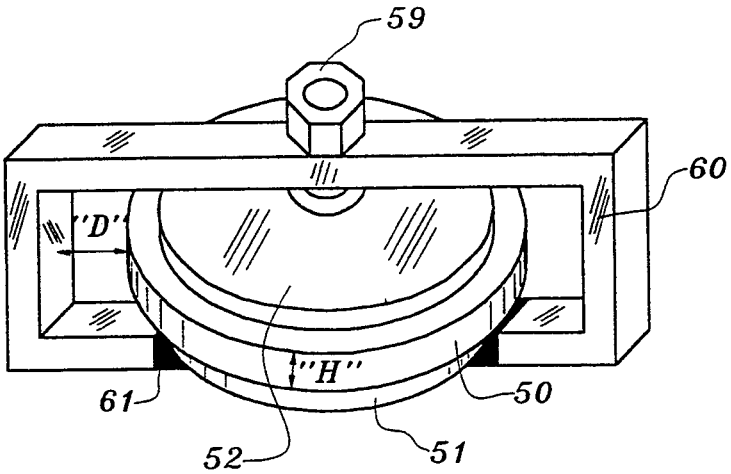
FIG. 5 is a partial bottom perspective view of the magnetic structure of the loudspeaker of FIG. 4.

As best seen in FIG. 5, magnetically permeable member 60 is substantially U-shaped and is physically attached to threaded end 58 of the leg of first pole piece section 53 by a suitable nut 59. U-shaped permeable member 60 is insulated from bottom plate 52 by means of an insulating washer 56. The open ends of U-shaped permeable member 60 are insulated from top plate 52 by insulation 61. The added magnetic AC flux return paths through member 60 are in parallel with the magnet 50 and reduce the efficiency of the loudspeaker slightly. However, a typical loudspeaker magnet has sufficient energy reserve to supply extra steady state flux to the added paths without significant efficiency loss, e.g. 0.5 to 1.5 dB, provided permeable member 60 is properly proportioned. The relative sizes depicted for member 60 and the loudspeaker magnet structure shown in FIG. 5 are satisfactory. It has been experimentally determined that permeable member 60 should have a cross sectional area of 30% to approximately 100% of the square of the magnet height "H". The spacing "D" between the inner surface of the permanent magnet 50 and the member 60 should be as large as practical and preferably greater than one-half of the magnet height "H".

Figure 6:
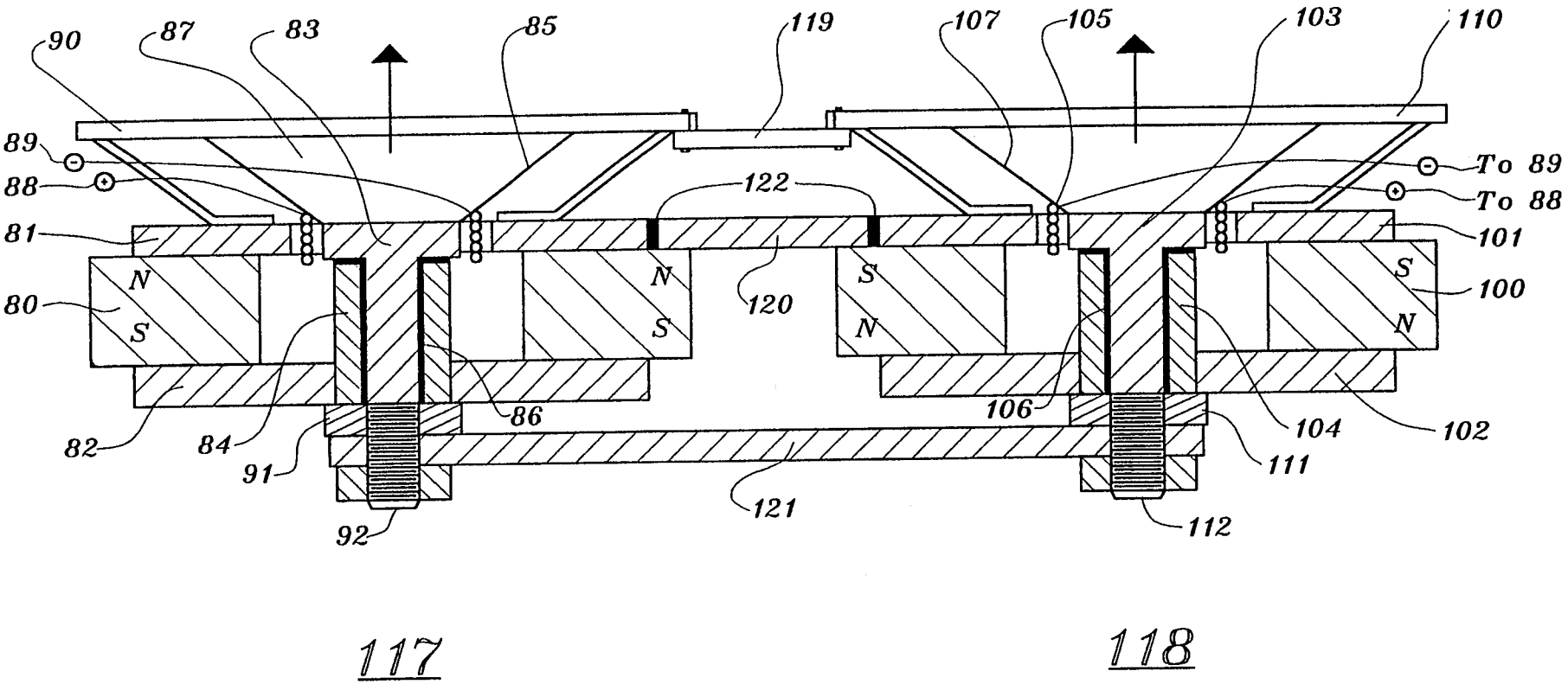
FIG. 6 is a partial sectional view of a pair of loudspeakers with intercoupled magnetic structures in accordance with the invention.

In FIG. 6, two loudspeakers are shown interconnected by magnetic feedback for the purpose of reducing both distortion in the individual loudspeaker drivers and differences between the individual drivers. A first loudspeaker 117 has a permanent magnet 80 mounted between magnetically permeable top and bottom plates 81, 82 respectively. A pole piece is transversely divided, in the manner illustrated in FIG. 4, into a T-shaped first section 83 and a cylindrical-shaped second section 84, with the two pole piece sections being electrically isolated from each other by a thin layer of insulation 86. Second pole piece section 84 is attached to a bottom plate 82 and a voice coil 85 is mounted for movement in the air gap formed between the inner circumference of a hole in top plate 81 and first pole piece section 83. The voice coil 85 is connected to AC signal input terminals 88 and 89. A loudspeaker cone 87 is attached to the voice coil 85 and to a speaker mounting basket 90.

A second loudspeaker 118, similar to loudspeaker 117, has a magnet 100 mounted between top and bottom plates 101 and 102 and a similarly divided pole piece having a first section 103 and a second section 104 that are electrically isolated from each other by thin insulation 106. Here again, the pole piece has a T-shaped first section with a leg that extends through a cylindrical second section, with insulation 106 separating the two. A voice coil 105, mounted for movement in an air gap formed by top plate 101 and first pole piece section 103, is also connected to AC signal input terminals 88 and 89. A cone 107 is attached to voice coil 105 and to a suitable loudspeaker basket 110. The magnets 80 and 100 are oppositely polarized as indicated by the polarity markings thereon. Magnet 80 of loudspeaker 117 has its North pole adjacent to top plate 91 and magnet 100 of loudspeaker 118 has its North pole away from top plate 101. The two voice coils 85 and 105 are wired such that, with the same AC signal applied to them, their respective cones will move in the same direction. This is indicated by the arrows above each speaker. Because of the oppositely poled magnets, the voice coils 85 and 105 must be phase-reversed so as to produce movement in the same direction with a common signal. Consequently, the AC fields generated by the voice coils are also reversed in direction with respect to each other. Coupling between the reverse direction AC fields establishes a mutual feedback condition between the two loudspeaker drivers. Extending the insulated first pole piece sections out the back of each loudspeaker provides a convenient means for coupling the first pole piece sections. A magnetically permeable bar 121 connects the ends 92 and 112 of first pole piece sections 83 and 103 and combines the phase reversed AC signals which reduces distortion. The thickness of the insulated spacers 91 and 111 should be approximately the same as the magnet thickness to isolate bar 21 from the bottom plates. Additional magnetically permeable conductive bars 119 and 120 may be added with coupling bar 120 being electrically isolated from front plates 81 and 101 by insulation 122. These additional low reluctance magnetic coupling members also couple the opposite poles of the two permanent magnets together so that the magnets aid each other which stabilizes the loudspeaker fixed magnetic circuits to further lower distortion. The mutual feedback has an important advantage in minimizing differences between the individual drivers. This is referred to as "synchronizing" of the drivers and is an unexpected but valuable outcome of coupling reverse polarity AC fields between multiple drivers. Without this synchronization, prior art multiple drivers, connected to a common signal, produce a diffused sound source that approximates the area encompassed by the drivers. After the addition of magnetic cross coupling in accordance with the invention, the individual drivers become synchronized and the apparent sound source is focused in the center, i.e. between the individual drivers. This combination, of improved fixed field magnet stability, lower eddy current distortion, and synchronization establishes a level of accuracy previously unavailable and unknown from multiple driver combinations.

Figure 7:
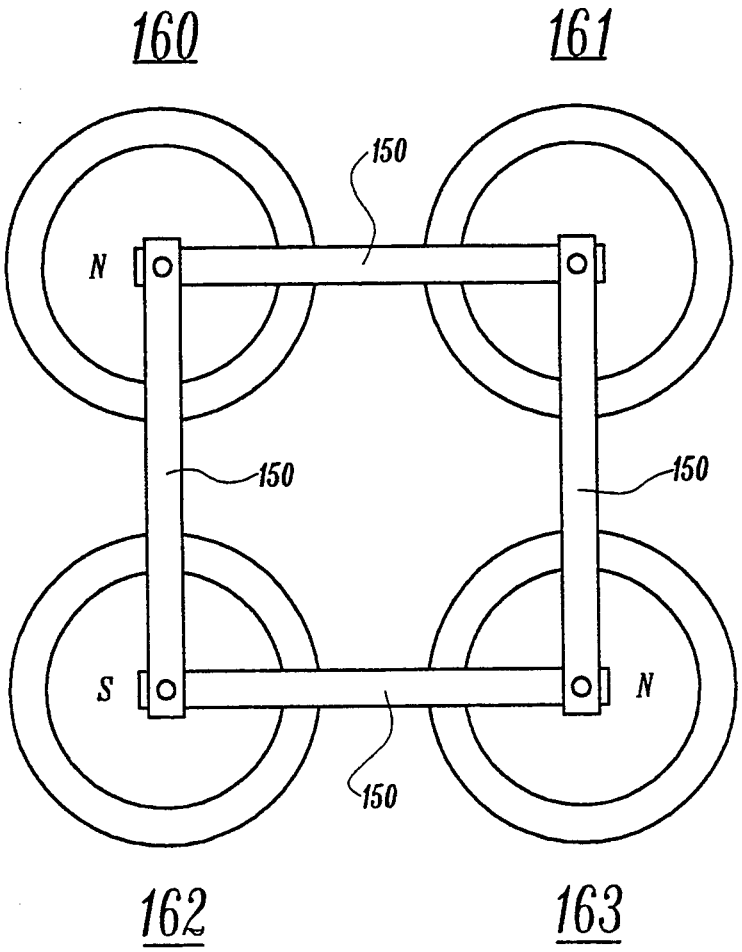
FIG. 7 illustrates four similar drivers mounted in a square pattern with magnetic feedback interconnections.

In FIG. 7, four loudspeaker drivers, 160, 161, 162, 163 are illustrated in a square pattern array. The drivers are magnetized such that each adjacent driver has reverse magnetic polarity. Additionally, each driver has its insulated extended pole section (as described above) interconnected by magnetically permeable conductive bars 150. This establishes a multiple interconnection between drivers and the resultant distortion reduction and synchronization is even more effective than with only a single pair of drivers. Configurations incorporating larger numbers of drivers can be arranged by grouping drivers in fours and constructing feedback interconnections between each reversed magnetized pair of drivers, substantially as illustrated in FIG. 7.

Figure 8:
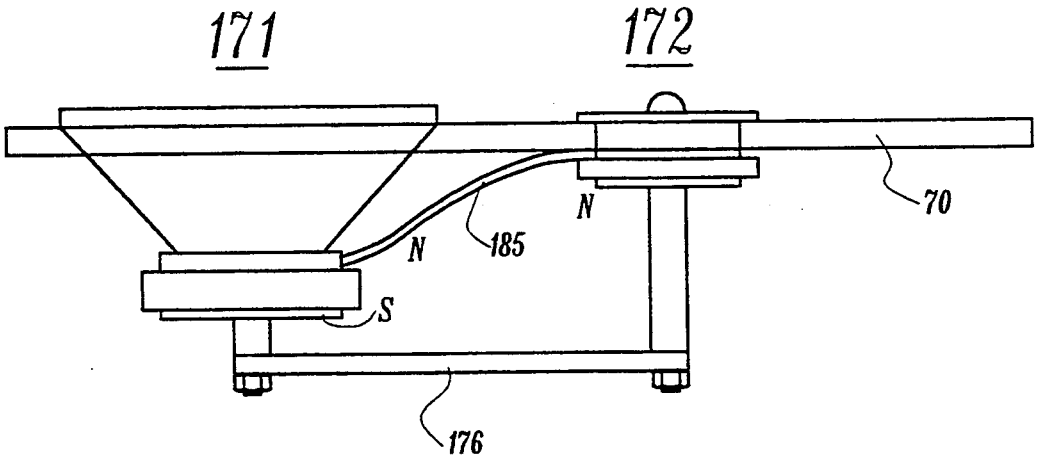
FIG. 8 shows a pair of loudspeakers, operable in different frequency bands, with magnetic intercoupling in accordance with the invention.

In FIG. 8, a pair of loudspeakers 171 and 172 are illustrated where each loudspeaker is designed to operate in a different frequency range. The signals passed to the voice coils of these drivers are restricted in frequency by suitable, well known crossover networks (not shown). The drivers are secured to a common baffle 170 and the magnets of the drivers polarized in opposite directions such that the North pole of the magnet of loudspeaker 171 is toward the baffle 170 whereas the North pole of loudspeaker 172 is away from the baffle 170. Each driver has its insulated first pole piece section (as described above) interconnected by a magnetically permeable and electrically conductive bar 176. A magnetic conductive bar 185 is also coupled between the top plate of the two loudspeakers. Because the drivers of the loudspeakers operate in different, but slightly overlapping frequency ranges, mutual (feedback) coupling is effected primarily in their frequency overlap region. This relatively narrow range of feedback smooths the transition between them and blends the character of the two physically different drivers.

What has been described is a novel arrangement for reducing distortion in loudspeakers which involves dividing the pole piece into two electrically isolated sections. It is recognized that numerous changes in the described embodiment of the invention will be apparent to those skilled in the art without departing from its true spirit and scope. The invention is to be limited only as defined in the claims.

What is claimed is:

1. A loudspeaker system comprising:

a magnetic structure including a permanent magnet, a magnetically permeable pole piece and first and second magnetically permeable plates for developing a unidirectional magnetic field in an air gap between said pole piece and said first magnetically permeable plate;

an AC signal carrying voice coil mounted for movement in said air gap, said voice coil undesirably generating distortion producing AC energy in the form of AC magnetic flux and eddy currents in said magnetic structure; and means dividing said magnetically permeable pole piece into at least first and second pole piece sections that are electrically isolated for reducing the distortion effects of said AC energy, said second pole piece section being physically directly connected to said second magnetically permeable plate.

2. The system of claim 1 wherein said first pole piece section lies substantially within said voice coil.

3. The system of claim 2 wherein at least said first pole piece section includes a longitudinal slot.

4. The system of claim 3, further including a slotted pole piece extension magnetically coupled to said first pole piece section for linearizing said magnetic field and reducing variations in the inductance of said voice coil.

5. The system of claim 1, further including a magnetically permeable extension piece magnetically coupled to said first pole piece section and electrically isolated from said second pole piece section.

6. The system of claim 5 wherein said extension piece is substantially U-shaped and is magnetically coupled to said first magnetically permeable plate.

7. The system of claim 5 wherein said first pole piece section is substantially T-shaped, said second pole piece section has a hollow, cylindrical shape and surrounds, but is electrically isolated from, the leg portion of said first pole piece section, and wherein said magnetically permeable extension piece is physically connected to said first pole piece section.

8. The system of claim 5, further including a second extension piece insulated from said first pole piece section and opposite from said extension piece for linearizing said magnetic field and reducing variations in the inductance of said voice coils.

9. The system of claim 1, further including;

a second magnetic structure, including first and second magnetically permeable plates and a magnetically permeable pole piece having first and second electrically isolated pole piece sections, having a second permanent magnet oppositely poled with respect to said permanent magnet;

a second AC voice coil arranged to move in the same direction as said AC voice coil in response to the same polarity of AC signal; and means magnetically coupling said magnetic structures.

10. The system of claim 9 wherein said coupling means comprises a magnetically permeable member coupling the first pole piece sections of said magnetic structures for offsetting distortion effects of said magnetic structures.

11. The system of claim 10, further including a second magnetically permeable member coupled between said first magnetically permeable plates of said magnetic structures.

12. The system of claim 11, further including an additional pair of magnetic structures, each of which includes oppositely poled permanent magnets and AC voice coils arranged to move in said same direction in response to the same polarity of AC signal.

13. The system of claim 9 wherein the voice coils of said magnetic structures are operable over different frequency ranges.

14. A loudspeaker system comprising:

a magnetic structure including a permanent magnet, a magnetically permeable pole piece and first and second magnetically permeable plates for developing a unidirectional magnetic field in an air gap between said magnetically permeable pole piece and said first magnetically permeable plate;

an AC signal carrying voice coil mounted for movement in said air gap, said voice coil undesirably generating distortion producing AC energy in the form of magnetic flux and eddy currents in said magnetic structure;

means dividing said magnetically permeable pole piece into electrically isolated first and second pole piece sections for reducing the distortion effects of said AC energy; and a magnetically permeable extension piece magnetically coupled to said first pole piece section.

15. The system of claim 14 wherein said first pole piece section is substantially T-shaped, said second pole piece section has a hollow, cylindrical shape and surrounds, but is electrically isolated from the leg portion of said first pole piece section, and wherein said magnetically permeable extension piece is substantially U-shaped and is physically connected to said first pole piece section and magnetically coupled to said first magnetically permeable plate.

16. A loudspeaker system comprising:

first magnetic structure means including a first permanent magnet, a first magnetically permeable pole piece divided into two electrically isolated sections for developing a unidirectional magnetic field in an air gap;

a first AC signal carrying voice coil mounted for movement in said air gap, said first voice coil undesirably generating distortion producing AC energy in the form of magnetic flux and eddy currents in said first magnetic structure means;

second magnetic structure means having a second permanent magnet oppositely poled with respect to said first permanent magnet, a second AC voice coil arranged to move in the same direction as said first AC voice coil in response to the same polarity of AC signal and a second magnetically permeable pole piece divided into two electrically isolated sections; and a first magnetically permeable member coupling corresponding ones of said isolated pole piece sections for offsetting distortion effects in said first and said second magnetic structure means.

17. The system of claim 16, further comprising first and second top and bottom permeable plates, said top plate cooperating with said first pole piece sections to form said air gaps, respectively, and a second magnetically permeable member coupling said first and second top plates.

* * * * *